US012416115B2

(12) United States Patent
Mittal et al.

(10) Patent No.: US 12,416,115 B2
(45) Date of Patent: Sep. 16, 2025

(54) DURABLE THERMOREGULATING TEXTILE STRUCTURES AND METHODS OF MANUFACTURE

(71) Applicant: Sysco Guest Supply, LLC, Somerset, NJ (US)

(72) Inventors: Khushboo Mittal, Somerset, NJ (US); Mohan Meiyappan Kandhasamy, Somerset, NJ (US); Imran Iqbal, Somerset, NJ (US)

(73) Assignee: Sysco Guest Supply, LLC, Somerset, NJ (US)

( * ) Notice: Subject to any disclaimer, the term of this patent is extended or adjusted under 35 U.S.C. 154(b) by 925 days.

(21) Appl. No.: 17/571,242

(22) Filed: Jan. 7, 2022

(65) Prior Publication Data

US 2022/0127780 A1 Apr. 28, 2022

Related U.S. Application Data

(63) Continuation-in-part of application No. 16/047,651, filed on Jul. 27, 2018, now abandoned.
(Continued)

(51) Int. Cl.
*D06M 13/535* (2006.01)
*D06B 3/10* (2006.01)
*D06M 11/84* (2006.01)

(52) U.S. Cl.
CPC ..... *D06M 13/535* (2013.01); *D06B 3/10* (2013.01); *D06M 11/84* (2013.01)

(58) Field of Classification Search
CPC .. D06M 13/535; D06M 11/84; D06M 13/165; D06M 13/17; D06M 2101/32;
(Continued)

(56) References Cited

U.S. PATENT DOCUMENTS 4,622,243 A 11/1986 Long
4,705,710 A 11/1987 Matsuda
(Continued)

FOREIGN PATENT DOCUMENTS

CN 105926119 A * 9/2016 ..... D02G 3/04
CN 106087435 A * 11/2016 ..... D06M 11/155
(Continued)

OTHER PUBLICATIONS

Heiq Smart Temp: Intelligent Thermiregulation, HeiQ, https://www.heiq.com/products/textile-technologies/heiq-smart-temp-thermoregulation/ (last accessed Mar. 13, 2025). (Year: 2025).*
(Continued)

*Primary Examiner* — William P Fletcher, III
(74) *Attorney, Agent, or Firm* — Lowenstein Sandler LLP

(57) ABSTRACT

A textile structure including one or more layers of warp yarns interwoven with one or more layers of weft yarns, a durable thermoregulating coating, and a binder that chemically bonds the durable thermoregulating coating to the textile structure. The warp yarns and/or weft yarns include polyester yarns. A method for manufacturing a textile structure includes weaving one or more layers of warp yarns with one or more layers or weft yarns to form a woven textile structure, brushing the textile structure at least two times, applying a binder to the textile structure, and applying a durable thermoregulating coating to the textile structure such that the binder chemically bonds the durable thermoregulating coating to the textile structure. The method may also include heat setting and curing the textile structure to fix the durable thermoregulating coating permanently onto the textile structure.

25 Claims, 7 Drawing Sheets
(6 of 7 Drawing Sheet(s) Filed in Color)

Related U.S. Application Data

(60) Provisional application No. 62/538,299, filed on Jul. 28, 2017.

(58) Field of Classification Search
CPC ..... D06M 11/38; D06M 13/1845; D06M 13/207; D06M 13/292; D06M 15/00; D06M 15/11; D06M 15/233; D06M 15/263; D06M 15/333; D06M 15/53; D06M 15/564; D06M 15/59; D06B 3/10; D06L 1/12; D06L 4/10; D06L 4/12; D06C 11/00
See application file for complete search history.

(56) References Cited

U.S. PATENT DOCUMENTS

| | | | | |
|---|---|---|---|---|
| 5,656,333 | A | 8/1997 | Truong et al. | |
| 6,586,059 | B1 * | 7/2003 | Michiels | C09K 21/04 428/36.1 |
| 6,607,995 | B1 | 8/2003 | Takeuchi et al. | |
| 7,743,476 | B2 | 6/2010 | Rock et al. | |
| 7,763,061 | B2 | 7/2010 | Schorr et al. | |
| 8,161,916 | B2 | 4/2012 | Bertocci et al. | |
| 9,894,944 | B2 | 2/2018 | Brooks et al. | |
| 2008/0057809 | A1 * | 3/2008 | Rock | D06M 15/643 442/119 |
| 2011/0250409 | A1 | 10/2011 | Marte et al. | |
| 2011/0300366 | A1 | 12/2011 | Henssen | |
| 2013/0337182 | A1 * | 12/2013 | Kim | D06M 13/005 427/372.2 |
| 2015/0106992 | A1 | 4/2015 | Blakely et al. | |
| 2015/0147518 | A1 | 5/2015 | Defranks et al. | |
| 2018/0163327 | A1 | 6/2018 | Jhunjhunwala | |
| 2019/0032273 | A1 | 1/2019 | Mittal et al. | |

FOREIGN PATENT DOCUMENTS

| | | | | |
|---|---|---|---|---|
| CN | 106351017 | A * | 1/2017 | |
| CN | 108221258 | A * | 6/2018 | D03D 13/008 |
| EP | 1894482 | A2 | 3/2008 | |
| EP | 2878723 | A2 | 6/2015 | |
| WO | 2015023779 | A1 | 2/2015 | |
| WO | 20190086322 | | 5/2019 | |

OTHER PUBLICATIONS

International Search Report and Written Opinion for related PCT application PCT/IB2022/062097 43144-29 L0010PCT2) dated Mar. 30, 2023; pp. 1-58.

Bhatkhande, Prasad S.; "Developement of Thermo-Regulating Fabric Using Phase Change Material (PCM)" Eastern Michigan University; Master's Theses and Doctoral Dissertations. Paper 361; pp. 1-64.

International Search Report and Written Opinion for related PCT application PCT/US2018/044065 dated Oct. 22, 2018; pp. 1-28.

Paul, Roshan; Funcional Finishes for Textiles: Improving Comfort, Performance and Protection Elsevier, Oct. 20, 2014; pp. 1-3.

* cited by examiner

T-0

T-1

T-2

T-0

T-1

DURABLE THERMOREGULATING TEXTILE STRUCTURES AND METHODS OF MANUFACTURE

CROSS-REFERENCE TO RELATED APPLICATIONS

This application claims priority of and is a Continuation-In-Part of U.S. patent application Ser. No. 16/047,651, titled "Durable Thermoregulating Textile Structures and Methods of Manufacture," filed on Jul. 27, 2018, that has been abandoned, which claims priority of U.S. Provisional Patent Application No. 62/538,299, filed Jul. 28, 2017 and titled "Durable Thermoregulating Textile Structures and Methods of Manufacture," the disclosures of which is incorporated herein by reference in its entirety.

TECHNICAL FIELD

Embodiments of the present disclosure relate to textile structures and their methods of manufacture thereof. More specifically, the present disclosure relates to textile structures for use in the hospitality industry.

BACKGROUND

Comfort is a pleasant state of psychological, physiological and physical harmony between the human being and the environment. The processes involved in human comfort are physical, thermophysiological, neuro-physiological and psychological. Thermo-physiological comfort is associated with the thermal balance of the human body, which strives to maintain a constant body core temperature of about 37° C. and a rise or fall of ~±5° C. can be fatal. Hypothermia and hyperthermia may result, respectively, due to the deficiency or excess of heat in the body, which is considered to be a significant factor in limiting work performance.

In a regular atmospheric condition and during normal activity levels, the heat produced by the metabolism is liberated to the atmosphere by conduction, convection and radiation and the body perspires in vapor form to maintain the body temperature. However, at higher activity levels and/or at higher atmospheric temperatures, the production of heat is very high and for the heat transmission from the skin to the atmosphere to decrease, the sweat glands are activated to produce liquid perspiration as well. The vapor form of perspiration is known as insensible perspiration and the liquid form as sensible perspiration. When the perspiration is transferred to the atmosphere, it carries heat (latent as well as sensible) thus reducing the body temperature. Therefore, any textile structure that comes in contact with the human body should allow the perspiration to pass through, otherwise it will result in discomfort. The perception of discomfort in the active case depends on the degree of skin wetness. During sweating, if the clothing moisture transfer rate is slow, the relative and absolute humidity levels of the clothing microclimate will increase, suppressing the evaporation of sweat. This may increase body temperatures, resulting in heat stress.

It is also important to reduce the degradation of thermal insulation caused by moisture build-up. If the ratio of evaporated sweat and produced sweat is very low, moisture will be accumulated in the inner layer of the textile structure, thus reducing the thermal insulation and causing unwanted loss in body heat. Therefore, both in hot and cold weather and during normal and high activity levels, moisture transmission through fabrics plays a major role in maintaining the wearer's body at comfort. Hence, a clear understanding of the role of moisture transmission through textile structures in relation to body comfort is essential for designing high performance textile structures for specific applications.

SUMMARY

Embodiments of the present disclosure relate to textile structures and their methods of manufacture thereof. More specifically, the present disclosure relates to textile structures for use in the hospitality industry.

Accordingly, one example embodiment is a textile structure including one or more layers of warp yarns interwoven with one or more layers of weft yarns, and a durable thermoregulating coating. The durable thermoregulating coating may include at least one of an adaptive agent, a cleaning agent, a fabric softener, an antistatic agent, and citric acid. The thermoregulating coating may include about 30-50 gram per liter of Adaptive AC-06, supplied by HeiQ in Switzerland. The textile structure may further include a binder that may be selected from the group consisting of latex, elastomeric, acrylic binders, vinyl acrylic binders, vinyl acetate binders, styrene containing binders, butyl containing binders, starch binders, polyurethane binders, and polyvinylalcohol containing binders. The warp yarns have a warp density of about 100 to 120 epi, and may have a maximum linear mass density of at least about 75 denier with multiples of about 72 filaments per yarn. The weft yarns have a weft density of about 65 to 80 ppi, and may have a minimum linear mass density of at least about 150 denier with multiples of about 72 filaments per yarn. The number of filaments, however, is always more than the denier of each weft yarn.

Another example embodiment is a method for manufacturing a textile structure. The method includes weaving one or more layers of warp yarns with one or more layers or weft yarns to form a woven textile structure, and applying a durable thermoregulating coating to at least a portion of the textile structure. The method may also include brushing the textile structure at least two times, prior to applying the thermoregulating coating, to create a fuzzy and softer feel. Brushing increases the surface area for better absorption and adhesion of the thermoregulating coating on the fabric. The method may also include heat setting and curing the textile structure to fix the durable thermoregulating coating permanently onto the textile structure. The durable thermoregulating coating may include at least one of an adaptive agent, a cleaning agent, a fabric softener, an antistatic agent, and citric acid. The thermoregulating coating may include about 30-50 gram per liter of Adaptive AC-06, supplied by HeiQ in Switzerland. The textile structure may further include a binder that may be selected from the group consisting of latex, elastomeric, acrylic binders, vinyl acrylic binders, vinyl acetate binders, styrene containing binders, butyl containing binders, starch binders, polyurethane binders, and polyvinylalcohol containing binders. The warp yarns have a warp density of about 100 to 120 epi, and may have a maximum linear mass density of at least about 75 denier with multiples of about 72 filaments per yarn. The weft yarns have a weft density of about 65 to 80 ppi, and may have a minimum linear mass density of at least about 150 denier with multiples of about 72 filaments per yarn. The number of filaments, however, is always more than the denier of each weft yarn.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The foregoing aspects, features, and advantages of embodiments of the present disclosure will further be appreciated when considered with reference to the following description of embodiments and accompanying drawings. In describing embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

Figure 1:
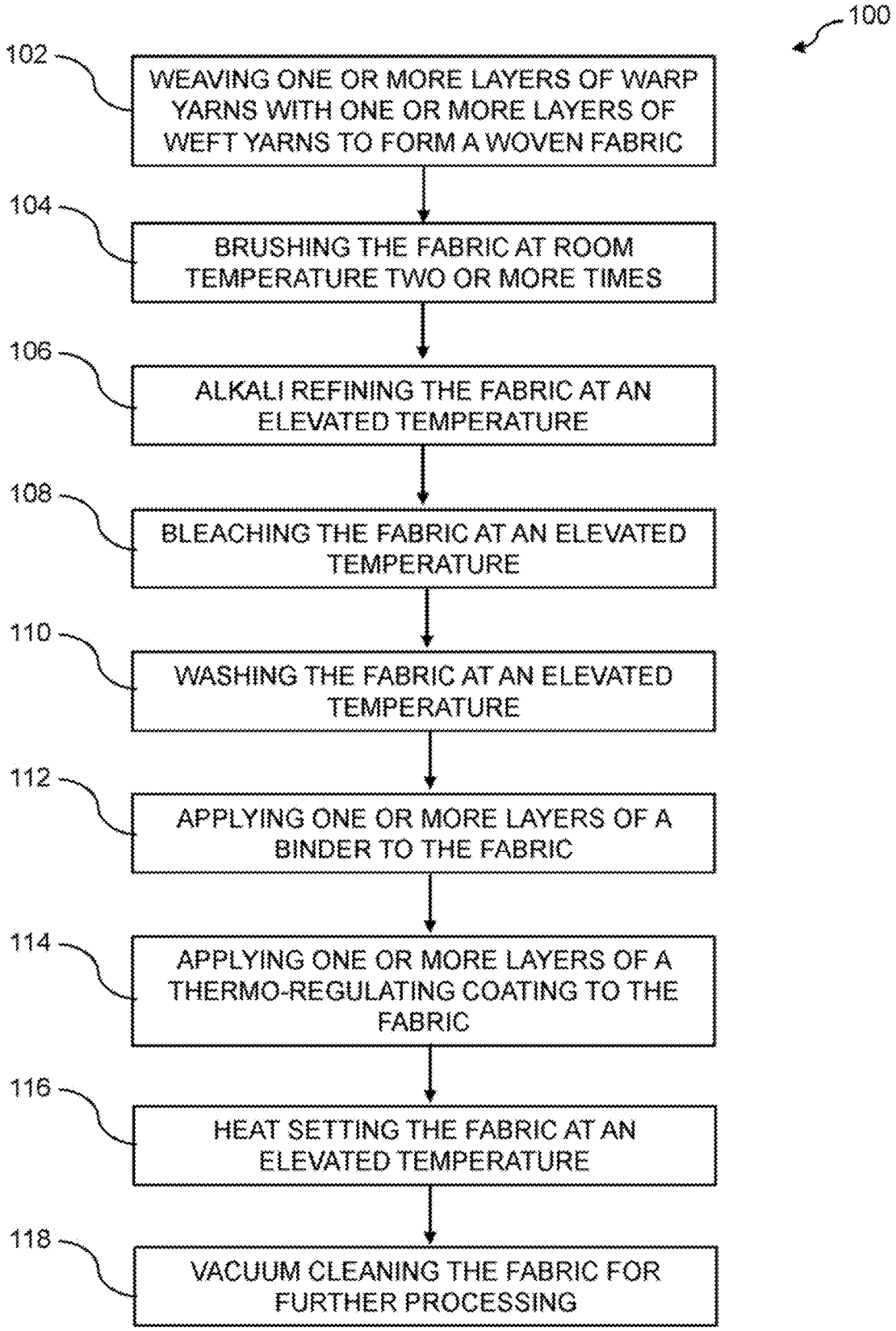

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the present invention Like reference numerals refer to like elements throughout the specification.

FIG. 1 illustrates example steps in a method for manufacturing a textile structure, according to one or more example embodiments.

Figure 2:
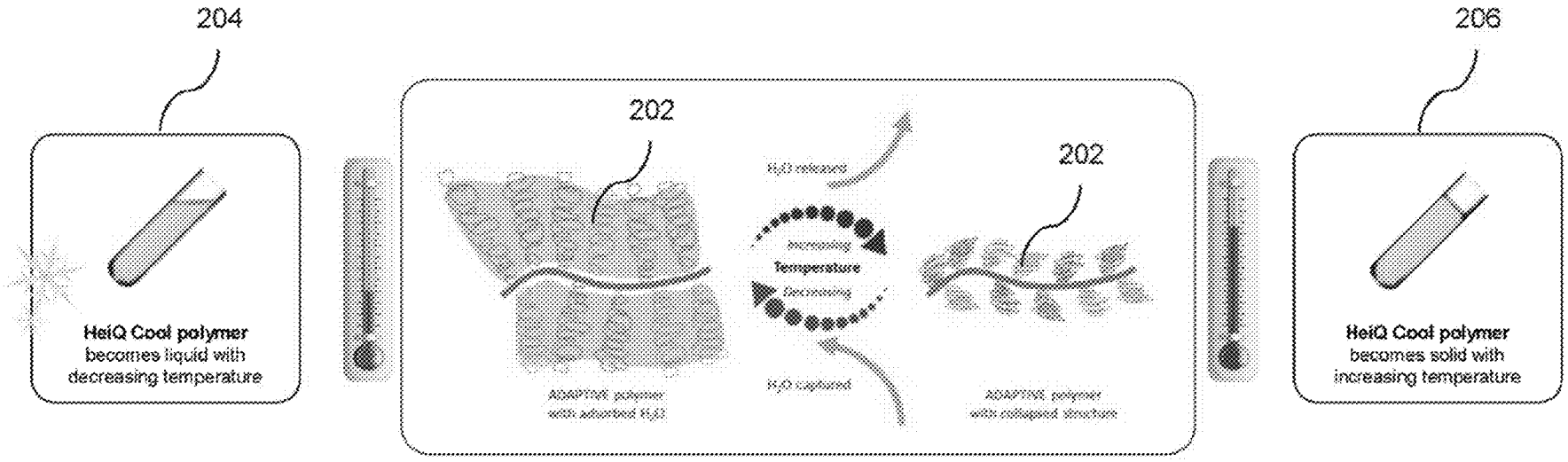

FIG. 2 illustrates the adaptive nature of the durable thermoregulating textile structure, according to one or more example embodiments.

Figure 3A:
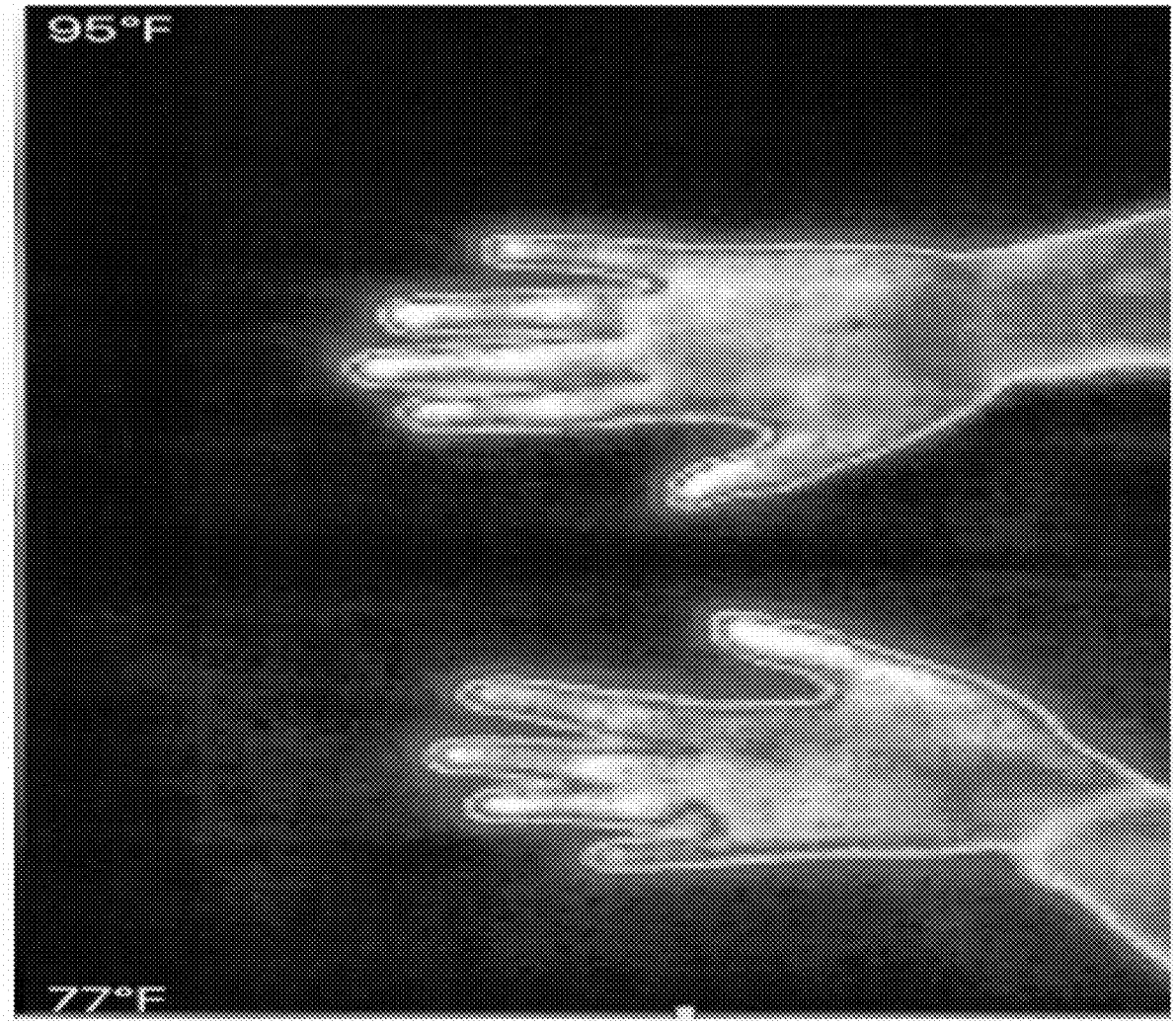
Figure 3B:
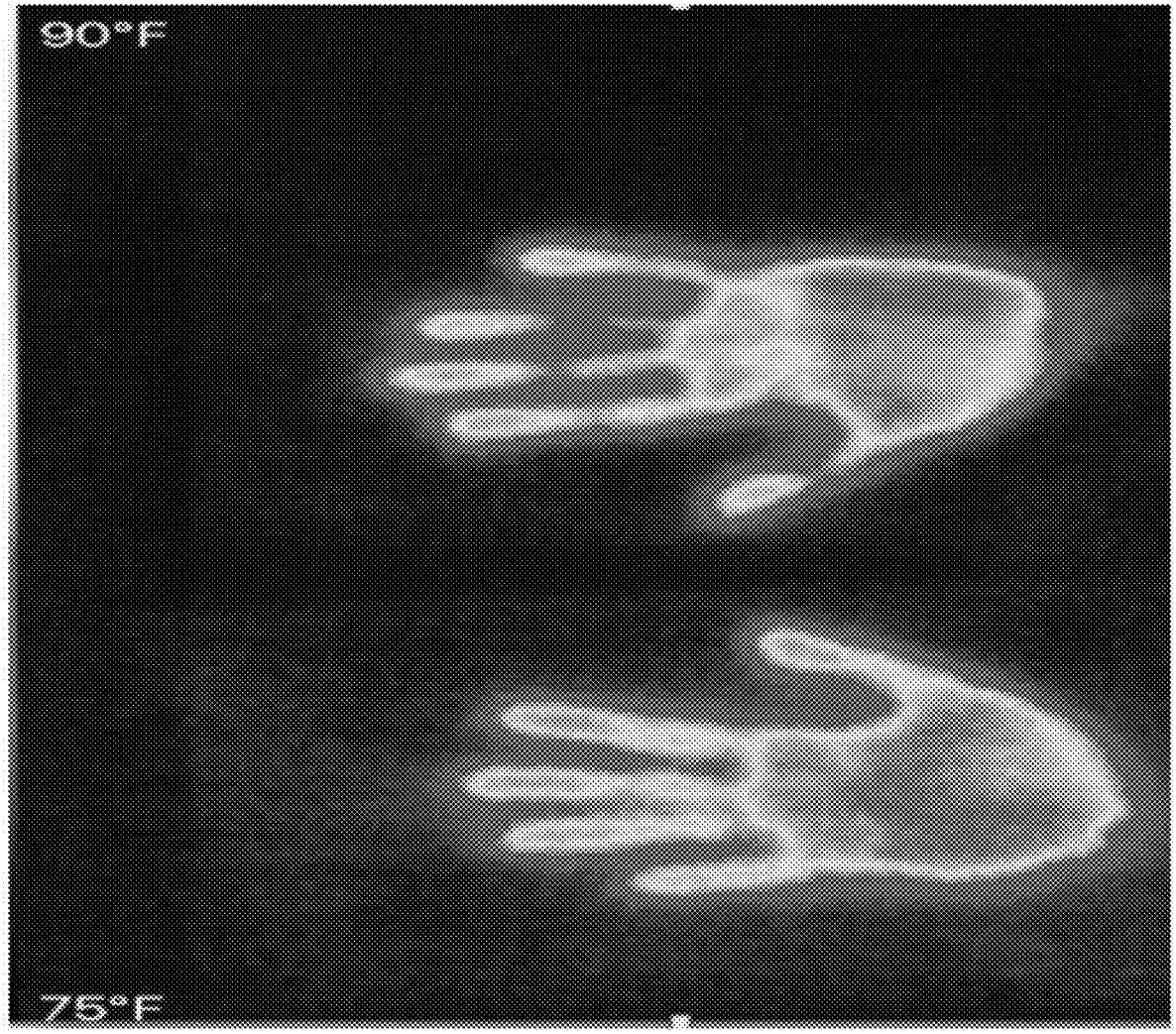
Figure 3C:
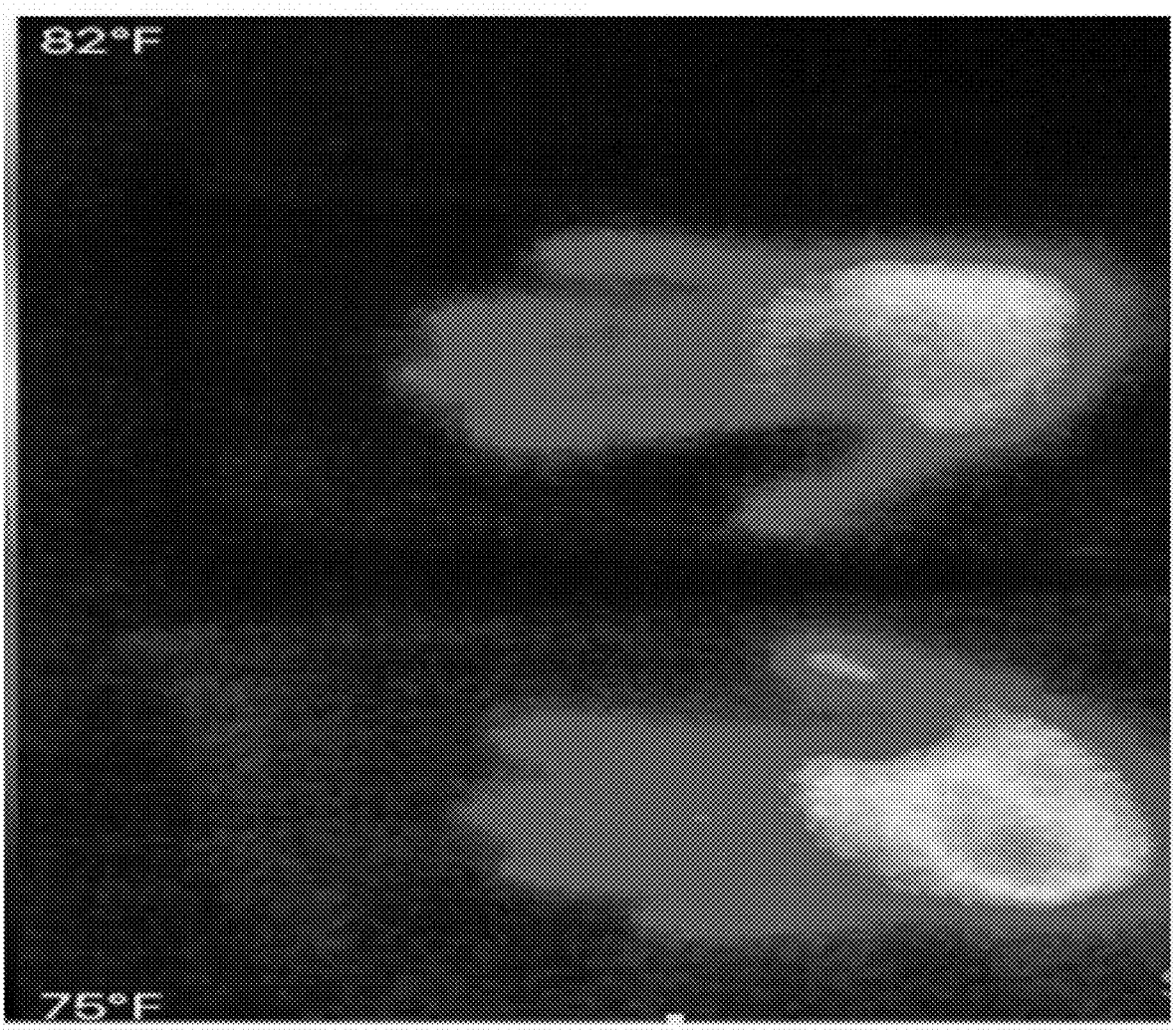

FIGS. 3A-3C illustrate how quickly the heat dissipates in the durable thermoregulating textile structure, according to one or more example embodiments.

Figure 4A:
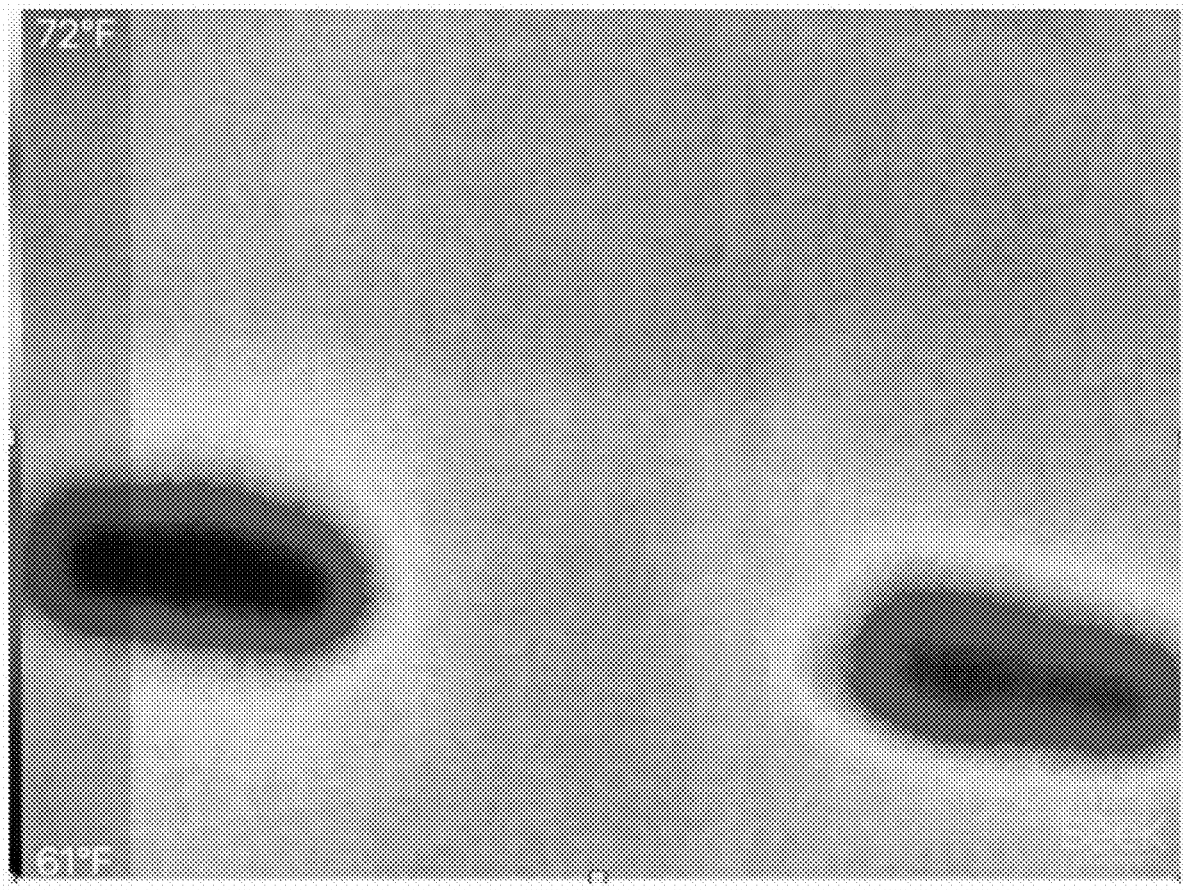
Figure 4B:
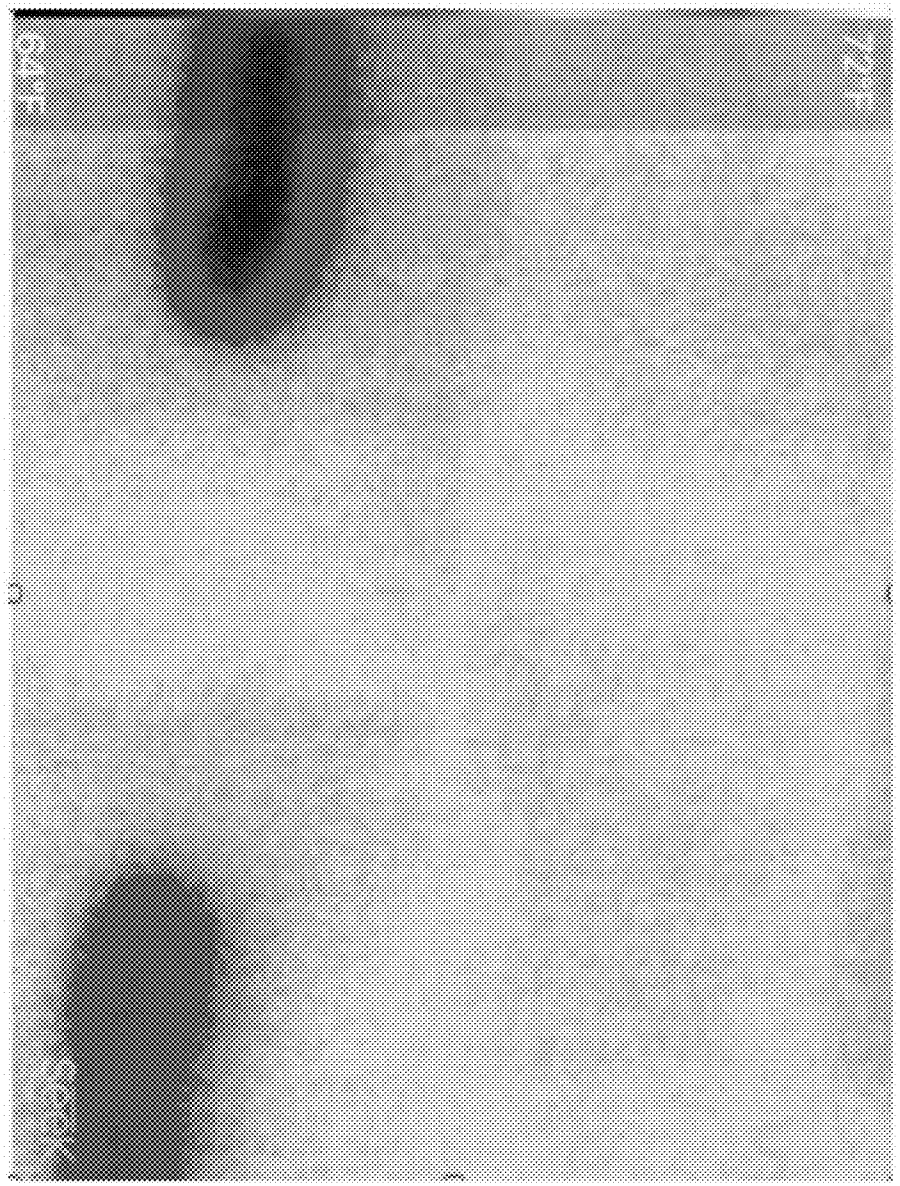

FIGS. 4A-4B illustrate how coolness may be equalized in the durable thermoregulating textile structure, according to one or more example embodiments.

DETAILED DESCRIPTION

Example embodiments relate to a woven polyester structure that dynamically responds to body temperature to keep one cool when they feel hot and keeps them warm when they feel cold. The thermoregulating aspect of the disclosure may be used in bedding products such as flat sheets, fitted sheets, pillowcases, pillow protectors, shells of pillows, shells of comforters, etc.

Turning now to the figures, FIG. 1 illustrates example steps in a method 100 for manufacturing a textile structure, according to one or more example embodiments. The method 100 includes weaving one or more layers of warp yarns with one or more layers or weft yarns to form a woven textile structure, at step 102. The warp yarns can have a warp density of about 100 to 120 epi, and may have a maximum linear mass density of at least about 75 denier with multiples of about 72 filaments per yarn. The weft yarns can have a weft density of about 65 to 80 ppi, and may have a minimum linear mass density of at least about 150 denier with multiples of about 72 filaments per yarn. The number of filaments, however, is always more than the denier of each weft yarn. Both warp and weft yarns may include yarns made of a polymeric material, such as polyester. While polyester is preferred, the structure may include any synthetic fiber that may be suitable for the purpose.

After the woven textile structure is formed, at step 104, the structure is mechanically brushed at least two times at room temperature. This process may be carried out at about 30 m/min speed to create a fuzzy and softer feel on the fabric. In the next step 106, the fabric may be passed through an alkali refining process where the alkali solution may include an alkali (5-10% of fabric weight), such as NaOH, one or more cleaning agents (1-2% of fabric weight), hydrogen peroxide (1-5% of fabric weight), and a chelating agent of about 0.5 gram per liter of the solution. The cleaning agent may include a soil release agent and/or a wetting agent. The pH value of this solution may be about 8-9, and with a pick-up of about 90-100% the fabric is run through this solution at about 100 m/min at an elevated temperature of about 130° C. After the alkali refining step 106, the fabric is bleached, at step 108, using a bleaching solution including a brightening agent of about 16 gram per liter of the solution, and an alkali (about 1% of fabric weight), such as NaOH. The pH value of this solution may be about 8-9, and with a pick-up of about 90-100% the fabric is run through this solution at about 100 m/min at an elevated temperature of about 130° C. After the fabric is bleached, it enters a washing zone, at step 110, where a steamer at 70-80° C. temperature steams the fabric with a solution having a pH of about 7-7.5. The fabric may be run through this section at about a reduced speed of 40 m/min.

The method further includes, at step 114, applying a durable thermoregulating coating to at least a portion of the textile structure. The durable thermoregulating coating may include one or more polymers mixed in an aqueous solution. For example, the durable thermoregulating coating may include an adaptive agent (HeiQ AC-06) in the amount of 30-50 gram per liter of the solution, a cleaning agent in the amount of 1-10 gram per liter, a fabric softener of about 5 gram per liter, an antistatic agent of about 5 gram per liter, and a citric acid of about 0.05 gram per liter. The adaptive agent may include, among other things, 0.5-1% triisobutyl phosphate, and 0.2-0.5% ethoxylated and propoxylated alcohols by percentage weight of the adaptive agent. The cleaning agent may include a soil release agent and/or a wetting agent. The cleaning agent may include, among other things, 30-50% isotrideceth 12, 10-15% 2-(2-butoxyethoxy)ethanol, 2-3% N-(2-Ethylhexyl)isononan-1-amide, and 1-2% Poly(oxy-1,2-ethanediyl), α-butyl-ω-hydroxy. The solution may have a pH of about 5-7, and the fabric may be run through this solution at a speed of about 60 m/min at an elevated temperature of 190-200° C.

The method may optionally include, at step 112, applying a binder prior to application of the durable thermoregulating coating. The binder may be selected from the group consisting of latex, elastomeric, acrylic binders, vinyl acrylic binders, vinyl acetate binders, styrene containing binders, butyl containing binders, starch binders, polyurethane binders, and polyvinylalcohol containing binders. The method may also include, at step 116, heat setting and curing the textile structure to fix the durable thermoregulating coating permanently onto the textile structure. After the fabric goes through the heat setting and the finishing process, the fabric may be vacuum cleaned at a speed of about 30-40 m/min, at step 118. The resulting fabric can be cut and sewn to form, among other things, a sheeting fabric for use in the hospitality industry. However, the thermoregulating aspect of the disclosure may be also used in other bedding products such as flat sheets, fitted sheets, pillowcases, pillow protectors, shells of pillows, shells of comforters, etc.

One embodiment is a method of treating a fabric to improve its durability and dynamic evaporation performance. In this method, the fabric is first brushed mechanically two or more times at room temperature. The brushing process is carried out at about 30 m/min to create a fuzzy and softer feel on the fabric.

The fabric then moves to the next stage known as alkali refining. In this step, the fabric is run through an alkali solution or bath. The alkali solution or bath includes two different cleaning agents, an alkali, and a chelating agent. The main component of one of the cleaning agents is polyethoxylated alkyl alcohol, which is about 89%-93% by weight of that cleaning agent. There are two main components in second cleaning agent, namely sodium carbonate and sodium sulfate, which are present in about 48%-52% and 28%-30% by weight of that second cleaning agent, respectively. Along with the two main components, there are smaller quantities of polyethoxylated alkyl alcohol (about 7%-9% by weight of the second cleaning agent) and sodium tripolyphosphate (about 8%-10% by weight of the second cleaning agent). Both the cleaning agents are added around 1-2% by fabric weight in the alkali solution or bath. Chelating agent is the other component of the alkali solution or bath, which contains acrylate copolymer (about 10-13% by weight of the alkali solution) along with smaller quantities of sodium acetate trihydrate and sodium tripolyphosphate, which form about 0.5 gram per liter of the alkali solution. Lastly, the alkali solution including sodium hydroxide (about 5-10% of the fabric weight) and hydrogen peroxide (about 1-5% of the fabric weight). The fabric is moved through two chambers at a speed of about 100 m/min with a 90-100% pickup rate. The pH of the alkali solution is kept at around 8-9 with a steamer time around 150 min. Chamber 1 has a temperature of about 130° C. and Chamber 2 is where the required whiteness in the fabric is achieved.

After alkali refining, the fabric goes through a bleaching process where the fabric is run through a bleaching solution. The bleaching solution includes a brightening agent of about 16 gram per liter of the bleaching solution, and an alkali (NaOH) of about 1% of the fabric weight. The bleaching solutions also contains 1,4'-(p-phenylenediethene-2,1-diyl) bisbenzonitrile, 2,2'-(1,2-Ethenediyl)bis[5-methylbenzoxazole]; 1,2-Bis(5-methyl-2-benzoxazole)ethylene at about 7-10% by weight of the bleaching solution and 6-8% by weight of the bleaching solution, both dissolved in water, which is 76-77% by weight of the bleaching solution. The bleaching solution may also include polyvinylpyrrolidone in a small quantity of about 3-5% by weight of the bleaching solution. The temperate during the bleaching process is kept about 130° C. whereas the pH is kept about 8-9. The speed at which the fabric is run through the bleaching solution is about 100 m/min, and the steamer bedtime is about 150 min with approximately a 90-100% pickup rate.

The bleached fabric is then moved to a washing chamber whereas the pH of the washing solution is reduced to about 7-7.5. The washing is performed at about 70-80° C. at a fabric speed of about 40 m/min.

The next step in the process is a heat setting stage where a hydro functional coating is applied to the fabric to improve its durability and dynamic evaporation performance. The heat setting stage has a mixture of chemicals including an antistatic agent, citric acid, a softener, and a hydro functional chemical. The antistatic agent includes polyamide and polyethylene glycol at about 7-9% of the weight of the mixture. The softener contains 1,4-Benzenedicarboxylic acid, polymer with 1,2-ethanediol and alpha.-hydro-.omega.-hydroxypoly(oxy-1,2-ethanediyl) (about 4-6% of the weight of the mixture), and alkyl alcohol polyethoxylate (about 1-3% of the weight of the mixture) in an aqueous solution. The hydro functional coating (HeiQ Adaptive AC-06) includes among other things, 0.5-1% triisobutyl phosphate, and 0.2-0.5% ethoxylated and propoxylated alcohols, as a percentage weight of the hydro functional coating. The heat setting stage is performed at about 195-200° C. for 2 mins by keeping the pH level at around 5.5-7. Here, the fabric is run at about 60 m/min, which slower as compared to the other chambers. The final step is of vacuuming where fabric is vacuumed at about 30-40 m/min.

The above process results in an improved fabric with improved evaporation performance compared to a fabric without the above treatment. In one example, the fabric, without any washes, showed a dynamic evaporation performance of about 260-320%, and because of the above treatment, the same fabric, even after going through 100 wash cycles, showed a dynamic evaporation performance of about 240-300%. The dynamic evaporation test involves measuring the level of evaporation from samples at two different temperature conditions. The dynamic evaporation test data indicates that the Adaptive AC-06 treated fabric can achieve significant evaporation performance. Similarly, the vertical wicking (AATCC 179) test shows that the fabrics treated with Adaptive AC-06 effectively transport 'wick' liquid moisture so as to facilitate effective evaporative cooling. The weight the fabric used for this purpose may vary from about 50-100 g/m$^2$, preferably 90 g/m$^2$.

Accordingly, one example embodiment is a woven polyester structure that dynamically responds to body temperature to keep one cool when they feel hot and keeps them warm when they feel cold. The durable thermoregulating textile structure may be produced by weaving polyester microfilaments in an optimized ratio in warp and weft directions. Adaptive AC-06, a chemical from Swiss supplier HeiQ, may be used for finishing such a woven structure. It shows opposite, "non-Newtonian" behavior. The structure has high moisture affinity at low temperatures (moisture capture) and low moisture affinity at high temperatures (moisture release).

Durable thermoregulating textile structures according to example embodiments disclosed can withstand at least 100 commercial washes. A strong binder that molecularly bonds the polyester filaments to the Adaptive AC-06 chemical may be used. The binder may be colorless and may not make the hand of the fabric stiff or rough.

The durable thermoregulating fabric may be woven with polyester yarns, which may include filaments or multifilaments, with a warp density of about 100 to 120 epi. Each polyester yarn may have a maximum linear mass density of at least about 75 denier with multiples of about 72 filaments per yarn. The durable thermoregulating fabric may also include polyester yarns, which may include filaments or multifilaments, in the weft direction. The weft density of the textile structure may be anywhere from about 65 to 80 ppi. Each polyester yarn may have a minimum linear mass density of at least about 150 denier with multiples of about 72 filaments per yarn. The number of filaments, however, is always more than the denier of each weft yarn. Warp and weft yarns may be interwoven in any known pattern, including but not limited to plain, twill, satin, and sateen. The woven textile structure may be brushed, using for example a mechanical process similar to napping, to create a fuzzy and softer feel. This process also minimizes the undesirable sheen inherent to most synthetic fibers.

After the fabric is padded through a solution of binder, the fabric may be run through the Adaptive AC-06 solution. The binder may include any binder including but not limited to latex, elastomeric, and acrylic binders. Acrylic binders, vinyl acrylic binders, vinyl acetate binders, styrene containing binders, butyl containing binders, starch binders, polyurethane binders, and polyvinylalcohol containing binders are examples of binders that find utility in coating and finishing the fabric. Then the fabric is heat set and cured to fix the chemical permanently onto the fabric. The resultant polyester fabric is now a durable thermoregulating fabric.

FIG. 2 illustrates the adaptive nature of the durable thermoregulating textile structure 202, according to one or more example embodiments. As illustrated in the figure, the thermoregulating coating becomes liquid with decrease in temperature (204), and becomes solid with increase in temperature (206). A fabric or textile structure 202 treated with this durable thermoregulating coating absorbs water vapor and swells at lower temperatures, thereby giving a warming effect to the body, and releases water vapor and collapses at higher temperatures, thereby giving a cooling effect to the body. FIGS. 3A-3C, which are thermographic images of a sheeting fabric with the durable thermoregulating coating, illustrate how quickly the heat dissipates in the durable thermoregulating textile structure, according to one or more example embodiments. In these figures, the left hand rests on a control (untreated) fabric while the right hand rests on a fabric that is treated with the thermoregulating coating. It can be noticed here that as time passes, the right side cools faster than the left (untreated fabric) due to faster dissipation of heat in treated fabric. The images shown in FIG. 3A-3C are taken at 1 min intervals, and it can be seen here that the center of the palms, which is at about 90° F., cools down to about 80° F. within a span of about 2 mins on the thermoregulating side.

FIGS. 4A-4B illustrate how coolness may be equalized in the durable thermoregulating textile structure, according to one or more example embodiments. The images shown in FIG. 4A-4B are taken at 1 min intervals, and it can be seen here that the center of the impression, which is at about 70° F., cools down to about 65° F. within a span of about 1 min on the thermoregulating side. Here, two equally cold metal objects were placed on the left (control) and right side (treated). It can be noticed here that the dissipation of cold is faster in the thermoregulating fabric when compared to untreated fabric.

Evaluation of the Textile Structure

Two fabric types were tested by the Textile Protection and Comfort Center (T-PACC) in the College of Textiles at North Carolina State University. An advanced sweating manikin system and thermal imaging camera were used to evaluate and compare the response of the two fabric types. Test samples were tested at the TPACC testing facility. A mattress was covered with two sheets split vertically down the middle and tested with the sweating thermal manikin system. Fabric types were identified as Control (untreated fabric) and Phasology (fabric treated with durable thermoregulating coating), respectively. No clothing was worn during testing. A comforter was used during testing. The comforter consisted of 95% white duck feathers/5% white duck down in a 100% polyester cover. The weight of the comforter was about 16.3 oz/yd$^2$. The mattress cover was tested on a twin mattress in the test chamber.

The sweating manikin system is a "Newton" type instrument designed to evaluate heat and moisture management properties of clothing systems. This instrument simulates heat and sweat production making it possible to assess the influence of clothing on the thermal comfort process for a given environment. Simultaneous heat and moisture transport through the clothing system, and variations in these properties over different parts of the body can be quantified.

The manikin consists of several features designed to work together to evaluate clothing comfort and/or heat stress. Housed in a climate-controlled chamber, the manikin surface is divided into 34 separate sections, each of which has its own sweating, heating, and temperature measuring system. With the exception of a small portion of the face, the whole manikin surface can continuously sweat.

Using a pump, preheated water is supplied from a reservoir located outside of the environmental chamber. An internal sweat control system distributes moisture to 139 "sweat glands" distributed across the surface of the manikin. Water supplied to the simulated sweat glands is controlled by operator entry of the desired sweat rate. Each sweat gland is individually calibrated and the calibration values are used by the control software to maintain the sweat rate of each body section. Water exuding from each simulated sweat gland is absorbed by a custom made body suit. This specialty designed suit acts as the manikin's 'skin' during sweating tests. It is form-fitted to the manikin to eliminate air gaps and provides wicking action to evenly distribute moisture across the entire manikin surface.

Continuous temperature control for the 34 body segments is accomplished by a process control unit that uses analog signal inputs from separate Resistance Temperature Detectors (RTDs). These evenly distributed RTDs are used instead of point sensors because they provide temperature measurements in a manner such that all areas are equally weighted. Distributed over an entire section, each RTD is embedded just below the surface and provides an average temperature for each section. Software establishes any discrepancy between temperature set point and the input signal, and adjusts power to section heaters as needed. Temperature controls are adjustable, by the operator, for each heater control.

The Newton sweating manikin system combined with ManikinPC2 control system allows the manikin to simulate human metabolism and thermoregulation while performing a variety of activities. The software and manikin interact in real-time setting imitating the transient behavior of the human body and allowing for the most accurate predictions of human physiological responses that can be achieved without actual human trials. The ManikinPC2 model control system is used to predict human physiological response including average skin temperature, final temperature of each manikin section, predicted core body temperature, as well as other parameters.

The FLIR A325 Infrared Camera is used to record thermographic images with temperature measurement. These non-contact temperature measurements allow for surface temperature evaluation of test items without interfering with the test operation. ThermoVision ExaminIR Analysis Software is used to read and analyze thermal images.

The purpose of this test was to evaluate the effectiveness of Phasology treatment on sheeting fabric compared to an untreated control fabric. The response of the fabric was assessed by use of a thermal imaging camera and manikin measurements. The two fabric types were taped into a single split-fabric mattress cover. Simultaneous evaluation of the two fabric types was accomplished by having the split-fabric mattress cover design that the manikin could be equally exposed to each side. The excess fabric was folded over top the manikin and taped at the seam. The manikin was dressed in the typical sweating skin material to assist with sweat wicking and spreading as well as a water vapor permeable/liquid water impermeable suit to limit the amount of liquid water pooling into the mattress. Test protocols were determined that used physiological model control of the manikin in which the manikin responded to the test environment and simulated sleeping condition based on a human thermoregulation model. The test environment was relatively mild. The mattress was tested once (Control right side/Phasology left side) per Test Protocol 1 (See Table 2). Table 1 shows the testing conditions/parameters used.

TABLE 1

| Testing Parameters | |
|---|---|
| Parameter | Value |
| Position/Movement | Horizontal on mattress/static |
| Sweat Rate | Varying based on physiological model control |
| Manikin Mode | Physiological Model Control |
| Skin Temperature | Model predicted |
| Heat Flux | Model dependent: metabolic rate = 0.95 MET |
| Chamber Temperature | 24° C. |
| Chamber Humidity | 50% |
| Airflow | 0.4 m/s |
| Test Articles | Split Treated/Untreated Sheet |

TABLE 2

| Test Protocol Test Protocol |
|---|
| 1. Lay manikin on bed on top of sheeting fabric |
| 2. Place comforter on manikin and add compression with weights to simulate human weight (~150 lbs.) |
| 3. Start model control |
| 4. Run manikin 3 hours in physiological model control mode |
| 5. Remove weight and comforter from manikin |
| 6. Record IR image of manikin immediately after testing is complete |
| 7. Lift manikin off bed |
| 8. Record IR image of sheeting fabric immediately after manikin is lifted off bed |
| 9. Record IR image every 30 sec for 10 minutes |
| 10. End Test |

Table 3 shows the average surface temperature and change in surface temperature from the defined Region of Interest (ROI). ΔT is defined as (T−Ti) and Time 0 is the time immediately after removing the manikin from the mattress.

TABLE 3

| Average Surface Temperatures for mattress ROIs | | | | |
|---|---|---|---|---|
| | Control | Phasology | Control | Phasology |
| Time | T (° C.) | T (° C.) | ΔT (° C.) | ΔT (° C.) |
| 0 | 26.9 | 27.8 | 0.0 | 0.0 |
| 5 | 23.4 | 22.9 | −3.4 | −4.8 |
| 10 | 23.1 | 22.3 | −3.8 | −5.4 |

Moisture Management Test (MMT)

The fabric was conditioned and tests were performed in the standard atmosphere laboratory condition of 70+3° F. (21° C.), 65+5% RH. The MMT is a system that can measure liquid transport properties of fabrics. A specific volume of electrically conductive fluid is injected onto the fabric surface at a controlled rate, and a series of conductive, copper rings monitor the movement of this fluid. The conductivity of the sample continuously changes as the fluid moves throughout the sample, and this data is recorded in order to determine the moisture management properties of the sample.

For the purpose of this test, the side of the fabric that contacts the skin is referred to as the "top surface," and the other side is referred to as the "bottom surface." The reported measurements include:

Wetting Time (s): WTT (top surface) and WTB (bottom surface)—period in which the top and bottom surfaces just start to get wetted Absorption Rate (%/s): ART (top surface) and ARB (bottom surface)—the average moisture absorption ability of the top and bottom surfaces Maximum Wetted Radius (mm): MWRT (top surface) and MWRB (bottom surface)—the maximum wetted ring radius at the top and bottom surface Spreading Speed (mm/s): SST (top surface) and SSB (bottom surface)—the accumulative spreading speed from the center to the maximum wetted radius The reported parameters calculated from the above measurements include:

One-way Transport Capability (%): R—the difference of the accumulative moisture content between the two surfaces of the fabric.

Overall Moisture Management Capacity: OMMC—an index to measure the overall capability of the fabric to manage the transport of liquid moisture based on three aspects of performance.

The results of these tests are summarized below (Table 4). Individual metrics were evaluated as well as two indices that quantify the moisture management properties of fabric, (One-way Transport Capability, and Overall Moisture Management Capacity). A higher value for either of these indices indicates a greater capability to effectively transport liquids. The results illustrate that even after 100 wash cycles, the overall moisture management capacity of the fabric is virtually unchanged.

TABLE 4

| Moisture Management Summary Sample | | | | | | | | | |
|---|---|---|---|---|---|---|---|---|---|
| | Wetting Time - Top (sec) | Wetting Time - Bottom (sec) | Absorption Rate - Top (%/sec) | Absorption Rate - Bottom (%/sec) | Max Wetted Radius - Top (mm) | Max Wetted Radius Bottom (mm) | Spreading Speed - Top (mm/sec) | Spreading Speed - Bottom (mm/sec) | Overall Moisture Management Capacity |
| Unwashed (P = 0) | 2.4 | 2.5 | 68.2 | 70.0 | 30.0 | 30.0 | 7.3 | 7.1 | 0.5 |
| 100x Washed (P = 100) | 2.5 | 2.6 | 53.4 | 60.8 | 30.0 | 30.0 | 7.3 | 7.2 | 0.6 |

A grading table is provided by SDL Atlas, manufacturers of the MMT device. These data, obtained under controlled laboratory conditions, characterize the moisture management properties of test sample responses in laboratory conditions.

| Index | | Grade 1 | 2 | 3 | 4 | 5 |
|---|---|---|---|---|---|---|
| Wetting Time (sec) | Top | >=120 No Wetting | 20~119 Slow | 5~19 Medium | 3~5 Fast | <3 Very Fast |
| | Bottom | >=120 No Wetting | 20~119 Slow | 5~19 Medium | 3~5 Fast | <3 Very Fast |
| Absorption Rate (%/sec) | Top | 0~10 Very Slow | 10~30 Slow | 30~50 Medium | 50~100 Fast | >100 Very Fast |
| | Bottom | 0~10 Very Slow | 10~30 Slow | 30~50 Medium | 50~100 Fast | >100 Very Fast |
| Max Wetted Radius (mm) | Top | 0~7 No Wetting | 7~12 Small | 12~17 Medium | 17~22 Fast | >22 Very Fast |
| | Bottom | 0~7 No Wetting | 7~12 Small | 12~17 Medium | 17~22 Fast | >22 Very Fast |
| Spreading Speed (mm/sec) | Top | 0~1 Very Slow | 1~2 Slow | 2~3 Medium | 3~4 Fast | >4 Very Fast |
| | Bottom | 0~1 Very Slow | 1~2 Slow | 2~3 Medium | 3~4 Fast | >4 Very Fast |
| OMMC | | 0~0.2 Very Poor | 0.2~0.4 Poor | 0.4~0.6 Good | 0.6~0.8 Very Good | >0.8 Excellent |

Accordingly, one example embodiment is a textile structure including one or more layers of warp yarns interwoven with one or more layers of weft yarns, and a durable thermoregulating coating. The durable thermoregulating coating may include at least one of an adaptive agent, a cleaning agent, a fabric softener, an antistatic agent, and citric acid. The cleaning agent may include a soil release agent and/or a wetting agent. The thermoregulating coating may include about 30-50 gram per liter of Adaptive AC-06, supplied by HeiQ in Switzerland. The textile structure may further include a binder that may be selected from the group consisting of latex, elastomeric, acrylic binders, vinyl acrylic binders, vinyl acetate binders, styrene containing binders, butyl containing binders, starch binders, polyurethane binders, and polyvinylalcohol containing binders. The warp yarns have a warp density of about 100 to 120 epi, and may have a maximum linear mass density of at least about 75 denier with multiples of about 72 filaments per yarn. The weft yarns have a weft density of about 65 to 80 ppi, and may have a minimum linear mass density of at least about 150 denier with multiples of about 72 filaments per yarn. The number of filaments, however, is always more than the denier of each weft yarn.

Another example embodiment is a method for manufacturing a textile structure. The method includes weaving one or more layers of warp yarns with one or more layers or weft yarns to form a woven textile structure, and applying a durable thermoregulating coating to at least a portion of the textile structure. The method may also include brushing the textile structure at least two times, prior to applying the thermoregulating coating, to create a fuzzy and softer feel. Brushing increases the surface area for better absorption and adhesion of the thermoregulating coating on the fabric. The method may also include heat setting and curing the textile structure to fix the durable thermoregulating coating permanently onto the textile structure. The durable thermoregulating coating may include at least one of an adaptive agent, a cleaning agent, a fabric softener, an antistatic agent, and citric acid. The thermoregulating coating may include about 30-50 gram per liter of Adaptive AC-06, supplied by HeiQ in Switzerland. The textile structure may further include a binder that may be selected from the group consisting of latex, elastomeric, acrylic binders, vinyl acrylic binders, vinyl acetate binders, styrene containing binders, butyl containing binders, starch binders, polyurethane binders, and polyvinylalcohol containing binders. The warp yarns have a warp density of about 100 to 120 epi, and may have a maximum linear mass density of at least about 75 denier with multiples of about 72 filaments per yarn. The weft yarns have a weft density of about 65 to 80 ppi, and may have a minimum linear mass density of at least about 150 denier with multiples of about 72 filaments per yarn. The number of filaments, however, is always more than the denier of each weft yarn.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The textile structures and methods described herein, therefore, are well adapted to carry out the objects and attain the ends and advantages mentioned, as well as others inherent therein. While example embodiments of the textile structure and method have been given for purposes of disclosure, numerous changes exist in the details of procedures for accomplishing the desired results. These and other similar modifications may readily suggest themselves to those skilled in the art, and are intended to be encompassed within the spirit of the textile structure and method disclosed herein and the scope of the appended claims.

What is claimed is:

1. A method for treating a fabric to improve durability and dynamic evaporation performance, the method comprising:

mechanically brushing the fabric two or more times at room temperature; wherein the brushing is carried out at about 30 m/min to create a fuzzy and softer feel on the fabric;

running the fabric in an alkali solution or bath at about 130° C.;

running the fabric in a bleaching solution;

washing the fabric at about 70-80° C.;

applying one or more layers of a thermoregulating coating to the fabric;

heat setting the fabric at about 195-200° C.; and vacuuming the fabric at about 30-40 m/min.

2. The method of claim 1, wherein the alkali solution or bath includes a first cleaning agent, a second cleaning agent, an alkali, and a chelating agent.

3. The method of claim 2, wherein the first cleaning agent comprises polyethoxylated alkyl alcohol at about 89%-93% by weight of the first cleaning agent.

4. The method of claim 2, wherein the second cleaning agent comprises sodium carbonate at about 48%-52% of the second cleaning agent and sodium sulfate at about 28%-30% by weight of the second cleaning agent.

5. The method of claim 4, wherein the second cleaning agent further comprises polyethoxylated alkyl alcohol at about 7%-9% by weight of the second cleaning agent and sodium tripolyphosphate at about 8%-10% by weight of the second cleaning agent.

6. The method of claim 2, wherein the first cleaning agent and the second cleaning agent are added at around 1-2% by fabric weight in the alkali solution or bath.

7. The method of claim 2, wherein the chelating agent comprises acrylate copolymer at about 10-13% by weight of the alkali solution and sodium acetate trihydrate and sodium tripolyphosphate, which form about 0.5 gram per liter of the alkali solution.

8. The method of claim 2, wherein the alkali solution further comprises sodium hydroxide at about 5-10% of fabric weight and hydrogen peroxide at about 1-5% of the fabric weight.

9. The method of claim 1, wherein the fabric is moved through the alkali solution at a speed of about 100 m/min with a 90-100% pickup rate.

10. The method of claim 1, wherein pH of the alkali solution or bath is kept at around 8-9 with a steamer time at around 150 min.

11. The method of claim 1, wherein the bleaching solution comprises a brightening agent at about 16 gram per liter of the bleaching solution, and an alkali (NaOH) of about 1% of fabric weight.

12. The method of claim 11, wherein the bleaching solution further comprises 1,4'-(p-phenylenediethene-2,1-diyl)bisbenzonitrile at about 7-10% by weight of the bleaching solution, 2,2'-(1,2-Ethenediyl)bis[5-methylbenzoxazole], and 1,2-Bis(5-methyl-2-benzoxazole)ethylene at about 6-8% by weight of the bleaching solution, each dissolved in water, which is about 76-77% by weight of the bleaching solution.

13. The method of claim 12, wherein the bleaching solution further comprises polyvinylpyrrolidone at about 3-5% by weight of the bleaching solution.

14. The method of claim 1, wherein temperature of the bleaching solution during the running of the fabric in the bleaching solution is kept about 130° C. and pH of the bleaching solution is kept at about 8-9.

15. The method of claim 1, wherein the fabric is run through the bleaching solution at about 100 m/min, and a steamer time is about 150 min with approximately a 90-100% pickup rate.

16. The method of claim 1, wherein the fabric is washed in a washing solution having a pH of about 7-7.5.

17. The method of claim 1, wherein the fabric is washed at a speed of about 40 m/min.

18. The method of claim 1, wherein the thermoregulating coating comprises an antistatic agent, citric acid, and a softener.

19. The method of claim 18, wherein the antistatic agent comprises polyamide and polyethylene glycol at about 7-9% of weight of the thermoregulating coating.

20. The method of claim 18, wherein the softener comprises 1,4-Benzenedicarboxylic acid, polymer with 1,2-ethanediol and alpha.-hydro-.omega.-hydroxypoly(oxy-1,2-ethanediyl) at about 4-6% of the weight of the thermoregulating coating, and alkyl alcohol polyethoxylate at about 1-3% of the weight of the thermoregulating coating in an aqueous solution.

21. The method of claim 18, wherein the thermoregulating coating further comprises 0.5-1% triisobutyl phosphate, and 0.2-0.5% ethoxylated and propoxylated alcohols, as a percentage weight of the thermoregulating coating.

22. The method of claim 1, wherein the heat setting of the fabric is performed for about 2 mins by keeping pH level at around 5.5-7.

23. The method of claim 22, wherein the fabric is run at about 60 m/min.

24. The method of claim 1, wherein a dynamic evaporation performance of the fabric after going through 100 wash cycles is about 240-300%.

25. The method of claim 1, wherein fabric weight is in range of about 50-100 g/m$^2$.

* * * * *